US008544240B2

(12) United States Patent
Hughes, Jr.

(10) Patent No.: US 8,544,240 B2
(45) Date of Patent: Oct. 1, 2013

(54) BALLISTIC CONSTRUCTION PANEL

(76) Inventor: John P. Hughes, Jr., Farmington, MI (US)

( * ) Notice: Subject to any disclaimer, the term of this patent is extended or adjusted under 35 U.S.C. 154(b) by 899 days.

(21) Appl. No.: 11/374,542

(22) Filed: Mar. 11, 2006

(65) Prior Publication Data

US 2013/0036952 A1 Feb. 14, 2013

(51) Int. Cl.
*E04C 2/32* (2006.01)

(52) U.S. Cl.
USPC ..... 52/783.17; 52/588.11; 52/783.14; 52/783.18; 52/802.11

(58) Field of Classification Search
USPC ..... 52/276, 279, 278, 282.1, 287.1, 588.1, 52/783.11, 783.1, 783.14, 783.17, 783.18, 52/784.14, 792.1, 802.11, 220.4, 800.1, 792.11, 52/532, 631
See application file for complete search history.

(56) References Cited

U.S. PATENT DOCUMENTS

| | | | | | |
|---|---|---|---|---|---|
| 787,065 | A | * | 4/1905 | White | 114/12 |
| 1,608,324 | A | * | 11/1926 | Knox | 52/461 |
| 1,855,161 | A | * | 4/1932 | Wyman | 428/186 |
| 2,039,601 | A | * | 5/1936 | London | 52/479 |
| 2,065,920 | A | * | 12/1936 | Clark | 52/275 |
| 2,576,530 | A | * | 11/1951 | Medal | 52/588.1 |
| 2,641,029 | A | * | 6/1953 | Trimmer | 52/288.1 |
| 2,786,004 | A | * | 3/1957 | Schwartz et al. | 52/406.3 |
| 2,934,934 | A | * | 5/1960 | Berliner | 52/601 |
| 3,228,361 | A | | 1/1966 | Ritter | |
| 3,231,452 | A | * | 1/1966 | Thomas | 428/116 |
| 3,287,854 | A | * | 11/1966 | Dasovic et al. | 49/501 |
| 3,314,846 | A | * | 4/1967 | Niwa | 428/12 |
| 3,412,518 | A | * | 11/1968 | Waite | 52/591.4 |
| 3,500,596 | A | * | 3/1970 | Andersson | 52/79.7 |
| 3,564,785 | A | * | 2/1971 | Kephart, Jr. | 52/71 |
| 3,604,374 | A | * | 9/1971 | Matson et al. | 109/81 |
| 3,643,393 | A | * | 2/1972 | Pierce et al. | 52/287.1 |
| 3,645,216 | A | * | 2/1972 | Radford et al. | 109/82 |
| 3,732,656 | A | * | 5/1973 | Robinsky | 52/108 |
| 3,766,699 | A | * | 10/1973 | Dinkel | 52/591.4 |
| 3,819,466 | A | * | 6/1974 | Winfield et al. | 428/175 |
| 4,106,245 | A | * | 8/1978 | Lowe | 52/91.3 |
| 4,151,687 | A | * | 5/1979 | Kephart, Jr. | 52/71 |
| 4,192,108 | A | * | 3/1980 | Lowe | 52/783.11 |
| 4,219,980 | A | * | 9/1980 | Loyd | 52/309.1 |
| 4,223,053 | A | * | 9/1980 | Brogan | 428/34.5 |
| 4,227,356 | A | * | 10/1980 | Stern et al. | 52/309.4 |
| 4,288,962 | A | * | 9/1981 | Kavanaugh | 52/742.13 |
| 4,566,237 | A | * | 1/1986 | Turner | 52/269 |
| 4,588,651 | A | * | 5/1986 | Israeli | 428/594 |

(Continued)

FOREIGN PATENT DOCUMENTS

WO 2006068605 A1 6/2006

OTHER PUBLICATIONS

International Search Report and Written Opinion for PCT/US07/69017.

*Primary Examiner* — William Gilbert
*Assistant Examiner* — James Ference
(74) *Attorney, Agent, or Firm* — Brooks Kushman P.C.

(57) ABSTRACT

A ballistic resistant construction panel having a series of elongated channels formed by coupling a corrugated member to adjacent planar wall members. These channels are filled with sand to provide the ballistic resistance of the panel. These panels are constructed of a fiber-reinforced plastic material and may be assembled together to form a temporary shelter.

19 Claims, 15 Drawing Sheets

(56) References Cited

U.S. PATENT DOCUMENTS

| | | | | |
|---|---|---|---|---|
| 4,617,072 | A * | 10/1986 | Merz | 156/89.25 |
| 4,699,251 | A * | 10/1987 | Orndorff et al. | 187/401 |
| 4,769,968 | A * | 9/1988 | Davis et al. | 52/798.1 |
| 4,796,396 | A * | 1/1989 | Menchetti | 52/127.5 |
| 4,916,027 | A * | 4/1990 | DelMundo | 428/586 |
| 5,245,803 | A * | 9/1993 | Haag | 52/90.1 |
| 5,251,414 | A * | 10/1993 | Duke | 52/309.16 |
| 5,348,601 | A * | 9/1994 | Ray | 156/155 |
| 5,349,893 | A * | 9/1994 | Dunn | 89/36.05 |
| 5,424,113 | A * | 6/1995 | Ray et al. | 428/178 |
| 5,425,207 | A * | 6/1995 | Shayman | 52/79.9 |
| 5,435,226 | A * | 7/1995 | McQuilkin | 89/36.02 |
| 5,640,824 | A * | 6/1997 | Johnson et al. | 52/578 |
| 5,654,518 | A * | 8/1997 | Dobbs | 89/36.02 |
| 5,678,384 | A * | 10/1997 | Maze | 52/783.17 |
| 5,729,936 | A * | 3/1998 | Maxwell | 52/220.2 |
| 5,753,340 | A * | 5/1998 | Welch et al. | 428/117 |
| 5,758,463 | A * | 6/1998 | Mancini, Jr. | 52/309.12 |
| 5,791,118 | A * | 8/1998 | Jordan | 52/783.11 |
| 5,855,099 | A * | 1/1999 | Hoffman | 52/202 |
| 5,945,208 | A * | 8/1999 | Richards et al. | 428/294.7 |
| 6,044,603 | A * | 4/2000 | Bader | 52/309.7 |
| 6,080,495 | A * | 6/2000 | Wright | 428/623 |
| 6,197,402 | B1 | 3/2001 | Miller et al. | |
| 6,272,805 | B1 * | 8/2001 | Ritter et al. | 52/309.11 |
| 6,314,704 | B1 * | 11/2001 | Bryant | 52/745.1 |
| 6,412,231 | B1 * | 7/2002 | Palatin | 52/79.1 |
| 6,490,834 | B1 * | 12/2002 | Dagher | 52/506.01 |
| 6,503,856 | B1 * | 1/2003 | Broadway et al. | 442/366 |
| 6,656,858 | B1 * | 12/2003 | Cahill | 442/370 |
| 6,679,008 | B2 * | 1/2004 | Santa Cruz et al. | 52/79.1 |
| RE38,508 | E * | 4/2004 | Wright | 428/623 |
| 6,832,461 | B2 | 12/2004 | Crye et al. | |
| 6,941,720 | B2 * | 9/2005 | DeFord et al. | 52/783.14 |
| 7,051,489 | B1 * | 5/2006 | Swiszcz et al. | 52/783.18 |
| 7,127,865 | B2 | 10/2006 | Douglas | |
| 7,134,250 | B2 * | 11/2006 | Forrester et al. | 52/406.3 |
| 7,288,326 | B2 * | 10/2007 | Elzey et al. | 428/593 |
| 7,398,624 | B2 * | 7/2008 | Swiszcz et al. | 52/506.08 |
| 7,406,806 | B2 * | 8/2008 | Hallissy et al. | 52/481.1 |
| 7,562,508 | B2 * | 7/2009 | Dickinson et al. | 52/793.1 |
| 2002/0092265 | A1 * | 7/2002 | Lundberg et al. | 52/800.12 |
| 2003/0150182 | A1 * | 8/2003 | Chou et al. | 52/309.8 |
| 2003/0159400 | A1 * | 8/2003 | Forrester et al. | 52/783.17 |
| 2004/0060245 | A1 * | 4/2004 | Loblick et al. | 52/79.5 |
| 2004/0134162 | A1 * | 7/2004 | Douglas | 52/741.1 |
| 2004/0197519 | A1 * | 10/2004 | Elzey et al. | 428/68 |
| 2005/0086905 | A1 * | 4/2005 | Ralph et al. | 52/782.1 |
| 2006/0048640 | A1 * | 3/2006 | Terry et al. | 89/36.02 |
| 2006/0065111 | A1 * | 3/2006 | Henry | 89/36.02 |
| 2006/0248827 | A1 * | 11/2006 | Meeker | 52/309.15 |
| 2006/0286342 | A1 * | 12/2006 | Elzey | 428/131 |
| 2007/0224401 | A1 * | 9/2007 | Telander | 428/212 |
| 2008/0006146 | A1 * | 1/2008 | Magnusson et al. | 89/36.02 |
| 2008/0078038 | A1 | 4/2008 | Borazghi | |

* cited by examiner

BALLISTIC CONSTRUCTION PANEL

FIELD OF THE INVENTION

The present invention relates to structural panels used in construction and more particularly to ballistic resistant structural panels that can be assembled together to erect a shelter.

BACKGROUND OF THE INVENTION

Temporary shelters differ from traditional permanent buildings or structures in that a temporary shelter must be portable and relatively easy to construct. This is particularly true when the shelters must be constructed to provide housing for a large number of people in a short amount of time. For example, during a military deployment or an emergency situation where an area's housing may be destroyed or made uninhabitable.

Additionally, conventional temporary shelters deployed in combat zones or other areas where violence may break out are often not resistant to high-velocity projectiles, gunfire and/or fragmentation shrapnel. Currently, the Middle East is one such dangerous area. The desert environment of the area poses additional dangers to personnel stationed there as the extreme temperatures must also be taken into account when erecting shelters.

Currently, temporary shelters are limited to traditional tents, which only offer limited protection against weather and to some pre-fabricated housing units which are no better than sheet-metal structures or cargo containers. These shelters offer little to no ballistic protection to their occupants. Additionally, with current shelters, deployment in certain environments, such as a desert, also highlights the fact that these shelters do not offer adequate thermal insulation.

Even if these shelters are ballistic resistant they usually achieve this resistance by using relatively expensive and exotic materials such as aramid fiber-based ballistic materials (e.g., Kevlar® or Nomex®) that are layered together to form panels. This protection also suffers from the drawback that every component of the panel must be manufactured at first location, stored at another, and then brought to the site, thereby increasing the logistical difficulties and expenses.

Other, less expensive, techniques of increasing the survivability of a structure include adding armor plating to the structure or surrounding the structure with earthworks, such as sandbags. Applying armor plating to existing conventional structures suffers from the drawback of lack of portability and high cost. While age-old earthen defenses offer a cheap means for increasing survivability and are readily available at the deployment location, the very high manual labor requirements of building earthworks around temporary structures is not desirable. Therefore, fortifying conventional structures using earthworks (e.g., sandbags) is not practical on a large scale.

Furthermore, the threat of terrorist activity, such as suicide-bombers, where an attack may occur from the inside of a structure may negate any armor or ballistic protection provided by the outer walls of a structure. There is therefore a need to provide a means to compartmentalize or cordon off areas within certain structures, e.g., command centers.

Presently, there exists a need to provide a means for constructing temporary shelters that have a high degree of ballistics protection (i.e., capable of stopping conventional small arms munitions) and that is portable and practical enough for rapid deployment and construction. It is particularly desirable to have a ballistically resistant temporary shelter which receives most of its protection from materials that are readily available at the location of deployment.

SUMMARY OF THE INVENTION

The present invention is a construction panel having improved ballistic resistance and a method of using the construction panel to build a structure.

It is a first advantage of the present invention to provide a construction panel which is resistant to substantially any conventional small-arms munitions.

It is a second advantage of the present invention to provide a ballistic resistant construction panel which is light-weight and readily transportable.

It is a third advantage of the present invention to provide a ballistic resistant construction panel that may be modified to address the potential threat level by adding additional layers of protection.

It is a fourth advantage of the present invention to provide a ballistic resistant construction panel that contains a earthen filler material, such as sand, that does not have to be shipped to a location as part of its ballistic protection.

It is a fifth advantage of the present invention to form a construction panel by coupling relatively thin and rigid sheets of fiber-reinforced plastic material together. These sheets include a generally waveform shaped corrugated member that is sandwiched between two planar sheets. The corrugated member's shape creates a plurality of elongated channels along the panel and these channels are reinforced against ballistic attack by filling them with a solid filler material, such as sand.

It is a sixth advantage of the invention to provide a ballistic construction panel including a plurality of generally planar and rigid structural sheets. The sheets include an inner-most sheet and an outer-most sheet and wherein each of the sheets is disposed parallel to each other. At least one rigid corrugated member is disposed between each adjacent sheet and is coupled to these adjacent sheets. The corrugated member and adjacent sheets cooperate to define a plurality of elongated cells. A reinforcing filler material is disposed within and fills the plurality of cells.

It is a seventh advantage of the present invention to provide a ballistic wall panel including a layered fiber-reinforced plastic construction panel that has a corrugated inner member between planar sheets. These sheets and corrugated member form vertical cells which are filled with sand. The wall panel further includes a channel-shaped sill that caps the bottom of the wall panel and prevents the sand from leaking out of the bottom of the wall panel.

It is an eighth advantage of the present invention to provide a method of making a ballistic construction panel by coupling a corrugated member between a pair of rigid planar sheet of fiber-reinforced plastic and filling the channels between the corrugated member and sheets with a readily available material, such as sand.

These and other objects, features and advantages of the present invention will become apparent from the following description when viewed in accordance with the accompanying drawings and appended claims.

DETAILED DESCRIPTION OF THE PREFERRED EMBODIMENT

Figure 1:
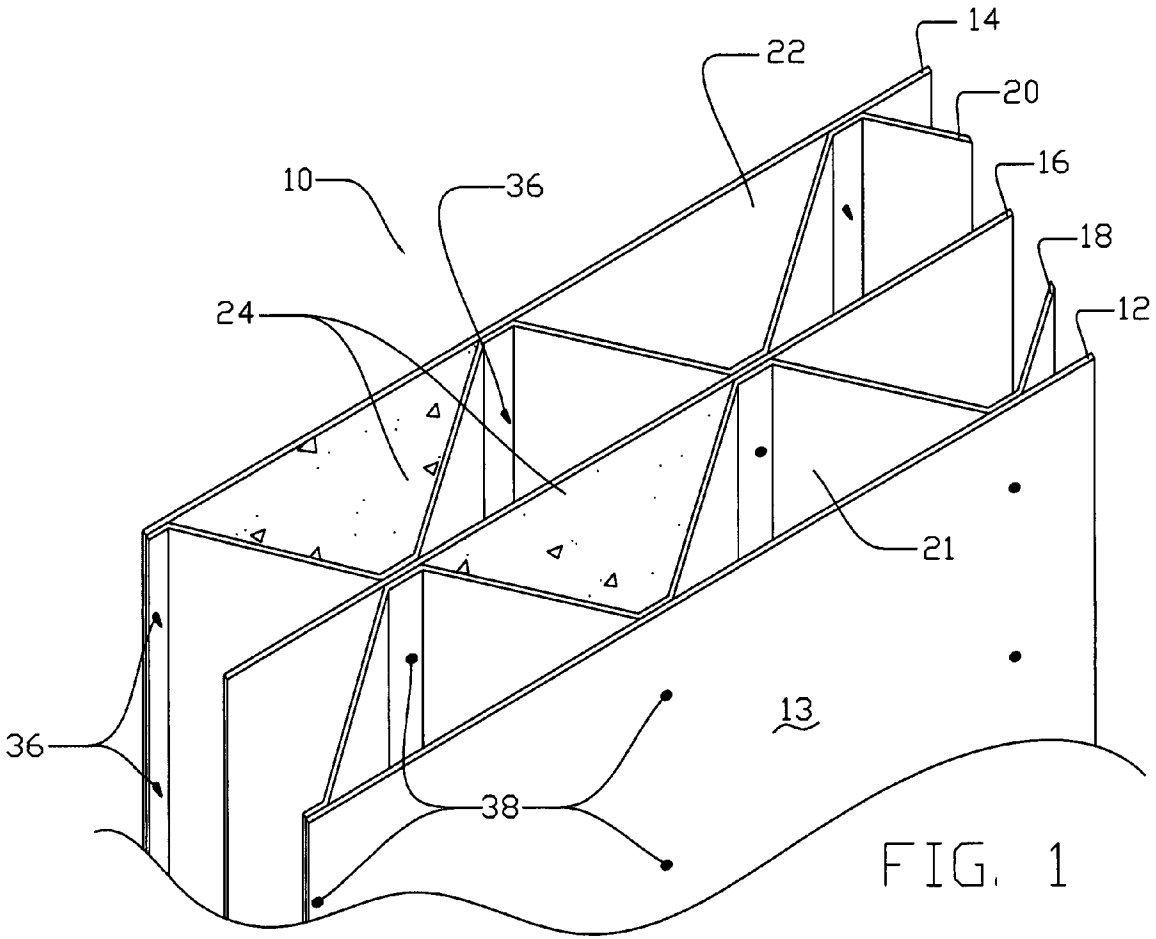
FIG. 1 is a perspective view of a ballistic construction panel.
Figure 2:
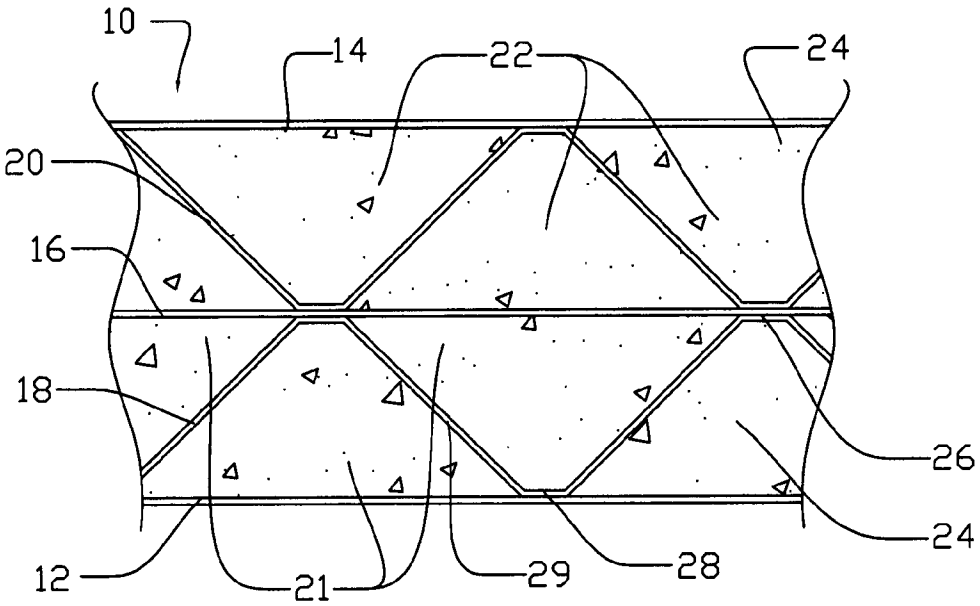
FIG. 2 is a top view of the construction panel illustrated in FIG. 1, the panel is shown retaining the ballistic reinforcing filler material, sand.
Figure 3:
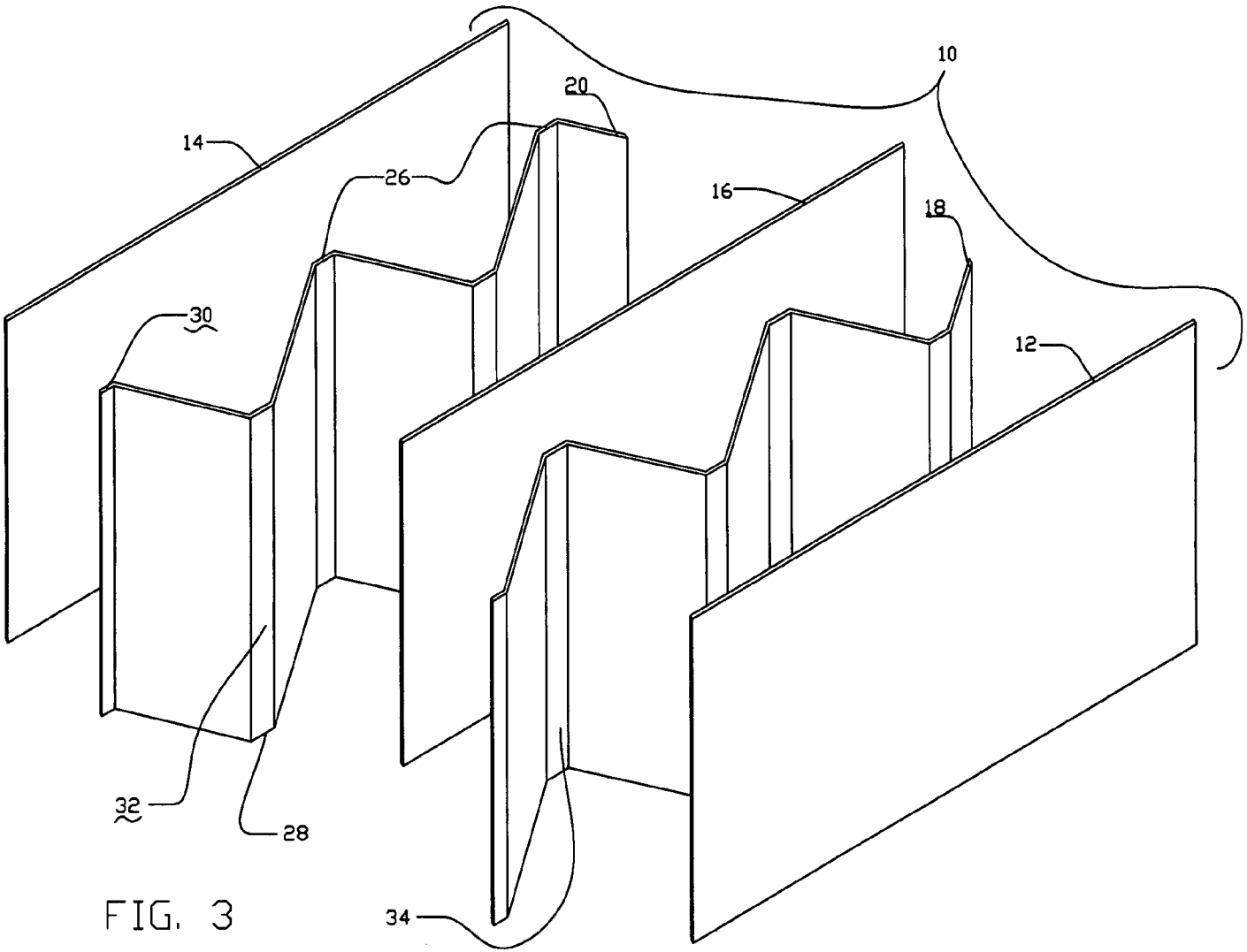
FIG. 3 is an exploded perspective view of the construction panel of FIGS. 1 and 2.

Referring now to FIGS. 1-3, there is shown a preferred embodiment of the present invention. As shown, a ballistic construction panel 10 includes an inner sheet member 12, an outer sheet member 14, and a middle sheet member 16. These sheets 12, 14, 16 are relatively thin, rigid, and planar and are disposed parallel to each other. A corrugated member is disposed between adjacent sheets. In the preferred embodiment, there are three sheets and therefore there are two corrugated members 18, 20. Corrugated member 18 is disposed between and abuts sheets 12 and 16 while corrugated member 20 is disposed between and abuts sheets 14 and 16. In this manner, a layered or sandwich arrangement is produced having alternating layers of a sheet, then a corrugated member, then a sheet, etc. By abutting the corrugated members 18, to the planar sheets 12-16 a plurality of enclosed cells or channels 21, 22 are formed within the panel 10. These cells 21, 22 are filled with a solid granular filler material 24, such as sand.

In the preferred embodiment, cells 21, 22 are filled with sand as it is readily available and therefore does not have to be transported with the sheets 12-16 and corrugated members 18, 20. In other embodiments, the cells 21, 22 may be filled with substantially any available filler material. For example and without limitation, the sand could be supplemented or replaced with almost any pourable solid earthen material such as gravel, crushed stone or they may be filled with a conventional pourable construction material like concrete.

Each sheet 12-16 is approximately 1/16 in. (1.5 mm) thick and can be substantially any length or height. The length and width are dependent on the particular application the panel 10 is intended for. For example, in the wall panel described below, the sheets are approximately 12 to 16 feet long and 7 to 8 feet high.

Each sheet 12-16 is formed from a strong lightweight material that can be processed in a manner which enables a single homogeneous sheet to have certain portions that are rigid, while other portions of the sheet are relatively flexible. The sheets are formed from a fiber-reinforced plastic material. In the preferred embodiment of the invention, the sheets are a fiber-reinforced thermoplastic material. The process of causing such a material to become rigid (i.e., inflexible) is generally called consolidation and a rigid plastic material will, for purposes of this description, be called consolidated, while the still flexible plastic material will be called unconsolidated. One such consolidation process is achieved by running a sheet of thermoplastic or thermosetting material through a machine which applies heat and/or infrared radiation and pressure to the sheet. A portion of the sheet that is protected from one or more of these energies will allow that portion to remain unconsolidated and flexible. One example of such a fiber-reinforced thermoplastic material is commercially available from Saint-Gobain Vetrotex America in Shelby, Mich. and marketed under the trademark "Twintex".

another benefit of using a fiber-reinforced thermoplastic materials such as TWINTEX®, a fabric having commingled fiberglass fibers and polyoefin fibers, is that these materials partially "self-heal" when punctured. That is, the material at the point of puncture deforms upon penetration, but partially returns back to its original location after the projectile passes through. So any ballistic projectile passing through a layer of such a material, such as outer sheet 14 will leave a hole that is smaller than the projectile. The resulting hole will allow little to no filler material 24 from escaping out of the sheet 14.

In other embodiments, the fiber-reinforced plastic material is a fiber-reinforced thermosetting plastic or composite material.

As shown in FIG. 2, the corrugated members 18, 20 are rigid corrugated sheets of homogenous material that have a uniform cross-section that is shaped as a repeating waveform. The waveform shape is created by manipulating a sheet similar to sheets 12-16 into the desired shape through conventional processes.

This waveform pattern creates two opposite facing sets of front and rear faces or webs portions 26, 28. The front faces 26 are all substantially co-planar with each other, thereby cooperatively providing a front surface 30. Similarly, the rear faces 28 are all substantially co-planar with each other, thereby cooperatively providing a rear surface 32. In the preferred embodiment, the corrugated members 18, 20 have a waveform cross-sectional shape of a trapezoid wave. That is, each corrugated member 18, 20 has a planar web or face 26 and a cross-piece 29 which projects from the face 26 toward an adjacent web or face 28. Face 28 is parallel to face 26. In the preferred embodiment, the trapezoid waveform profile is achieved by each interconnecting cross-piece 29 forming an obtuse internal angle with the two faces 26, 28 it connects. In other embodiments, this angle may be acute (where portions of adjacent faces 26, 28 would overlap) or 90 degrees. As a result of the trapezoidal shape, the faces 26, 28 are flat. The surfaces 30, 32 thereby present a generally flat surface.

The waveform cross-section of the corrugated members defines a series of generally concave channels 34 which span across each member 18, 20. Each channel 34 faces in the opposite direction to the channel 34 adjacent to it. While a trapezoid waveform has been described for the cross-sectional shape of the corrugated members 18, 20, it should be appreciated that corrugated members 18, 20 may have different cross-sectional shapes.

In the embodiment shown, the corrugated members have a uniform material thickness of approximately 5/64 in. (2 mm). The waveform repeats every six inches (e.g., each surface 26 is six inches away from the adjacent surface 26). The waveform has a height (i.e., the normal distance from surface 26 to surface 28) of approximately four inches. In this embodiment, each surface 26, 28 is approximately one inch across. The corrugated members 18, 20 are approximately the same size in length and height as the sheets 12-16. It should be appreciated that the dimensions provided above are for the preferred embodiment of the invention, but that the sizes and dimensions may vary.

Each corrugated member 18, 20 is formed from a material having similar properties as the sheets 12-16. In the preferred embodiment, the corrugated members 18, 20 are formed from the same fiber-reinforced plastic material as the sheets.

Figure 4:
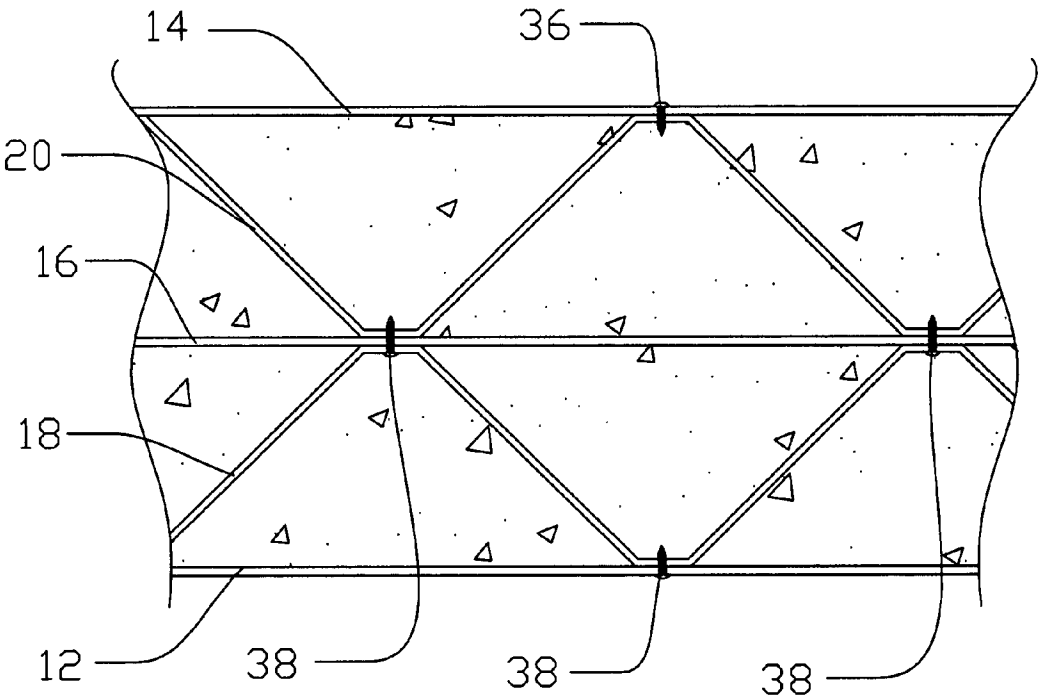
FIG. 4 is a partial top view of the construction panel of FIGS. 1-3 and shows means for coupling the panel components together.

As shown in FIG. 4, the sheets 12-16 are coupled to the corrugated members 18, 20 by conventional fastening means. These fastening means can be mechanical fasteners, such as screws, complementary nuts and bolts or rivets, or through an adhesive material.

The rear surface 32 (i.e., each face 28) of corrugated member 18 is abutted to the inner sheet 12 flatwise. Conventional fastening means (e.g., mechanical fasteners, adhesives, hook and pile arrangements) couple the sheet 12 and corrugated member 18 together at faces 28. In the preferred embodiment, reusable mechanical fasteners (e.g., nuts and bolts) are used to couple the sheets 12-16 to the corrugated members 18, 20 to allow the panel 10 to be disassembled.

The middle sheet 16 is placed in flatwise abutting arrangement against the front surface 30 of the corrugated member 18. As shown in FIG. 4, the other corrugated member 20 is first abutted against the opposite side of sheet 16 prior to coupling the members 18, 20 and sheet 16 together at their abutting surfaces 26, 28. The channels 34 of both corrugated members 18, 20 are oriented parallel to each other to aid in filling them with sand 24. By first placing the second corrugated member 20 with the sheet 16, prior to fastening, fewer fasteners are required to assemble the panel 10. To facilitate this coupling technique with conventional hardware (e.g., screws), the front faces 26 of member 18 must be aligned with the rear face 28 of member 20 to allow a single fastener to pass through both faces 26 and 28.

Lastly, the outer sheet 14 is coupled to the front face 26 of corrugated member 20 in the same manner as that described above for sheet 12 and member 16.

Preferably, each face 26, 28 that abuts a sheet receives a fastener. Multiple fasteners are used along each face 26, 28 at approximately one foot intervals.

In the preferred embodiment, the outer-most fasteners 36 are formed from a relatively soft material such as plastic or nylon to prevent jacketed armor-piercing ammunition from hitting a hard surface (e.g., a metal bolt head), thereby destroying the soft metal outer jacket and allowing the internal penetrator to continue on. The inner-most and middle fasteners 38 can be made of metal (or other material) to reduce cost. Some conventional fasteners, like bolts, require holes to be formed in the sheets 12-16 and corrugated members 18, 20. It should be appreciated that these apertures can be either pre-formed into the panels or drilled at the construction site.

Figure 5:
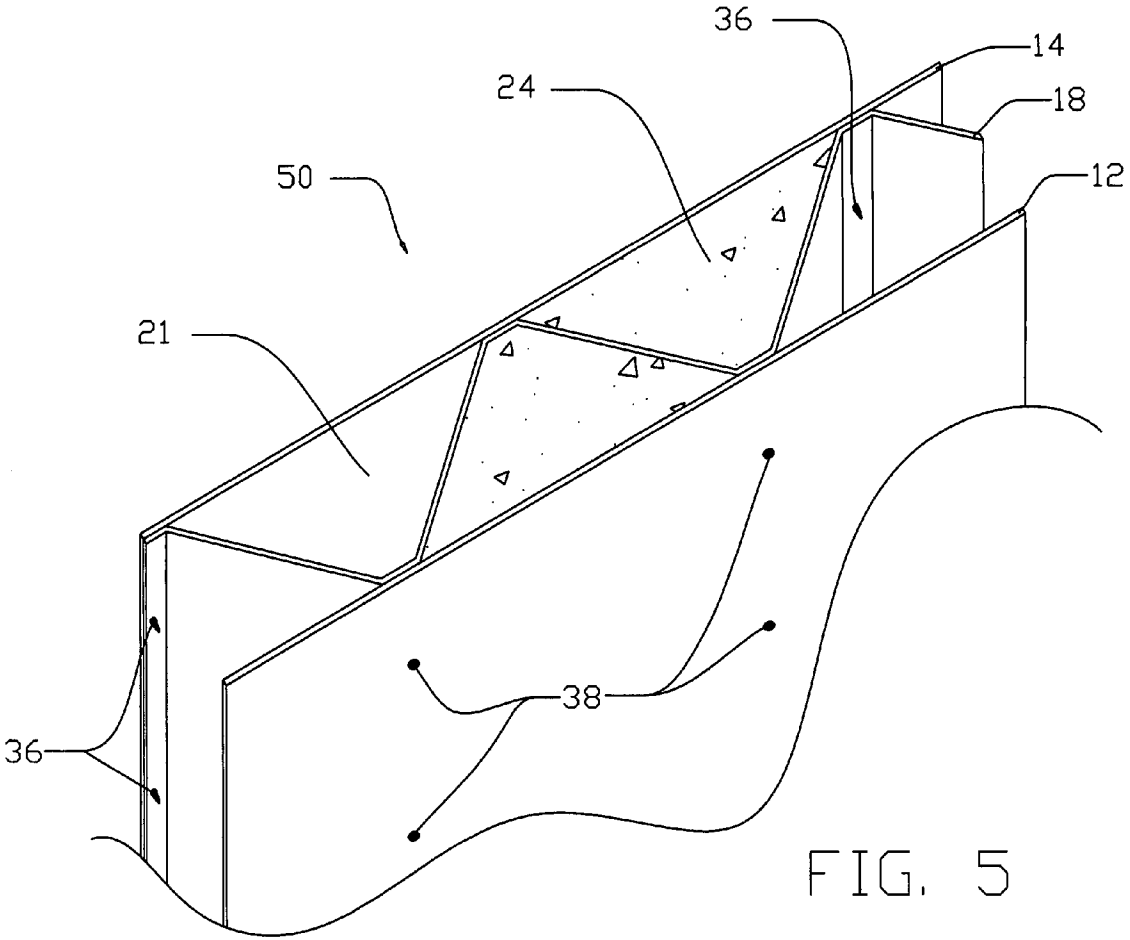
FIG. 5 is a perspective view of an alternate embodiment of a ballistic construction panel.

Referring now to FIG. 5, an alternate embodiment of the invention is illustrated. Ballistic construction panel 50 is substantially the same as panel 10, however only two sheets 12, 14 and one corrugated member 18 are layered together. As is partially shown, the cells 21 are filled with sand 24. In this embodiment the panel 50 is approximately half as thick as panel 10 and therefore requires less components and is easier to construct and transport, but offers less ballistic protection due to the reduced amount of sand 24 and lower number of sheets and corrugated members.

Figure 6:
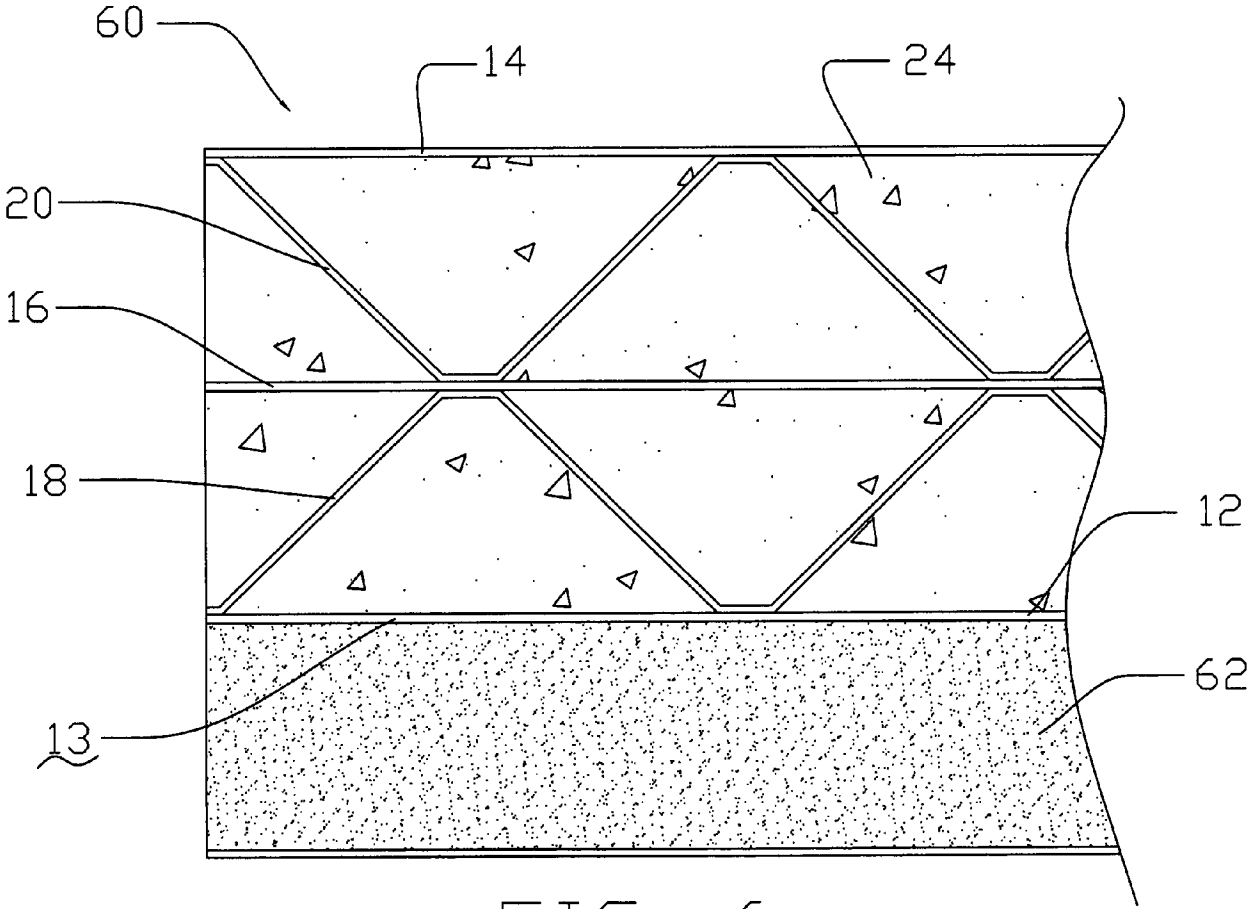
FIG. 6 is a top view of an yet another alternate embodiment of a ballistic construction panel having a layer of insulation.

Another alternate embodiment of the invention is illustrated in FIG. 6 where a ballistic construction panel 60 that is substantially the same as panel 10 includes a layer or panel 62 of thermally insulative material. This insulation 62 is coupled flatwise against the rigid wall section 13 of the panel 10 that is intended to face toward the inside of a structure. In the embodiment shown, insulation 62 is an expanded polystyrene foam board having an insulative R-value within the approximate range of 2 to 7 per inch of thickness. As shown, the insulation 62 is approximately four inches thick and is coupled to the wall 13 by conventional means.

Figure 7:
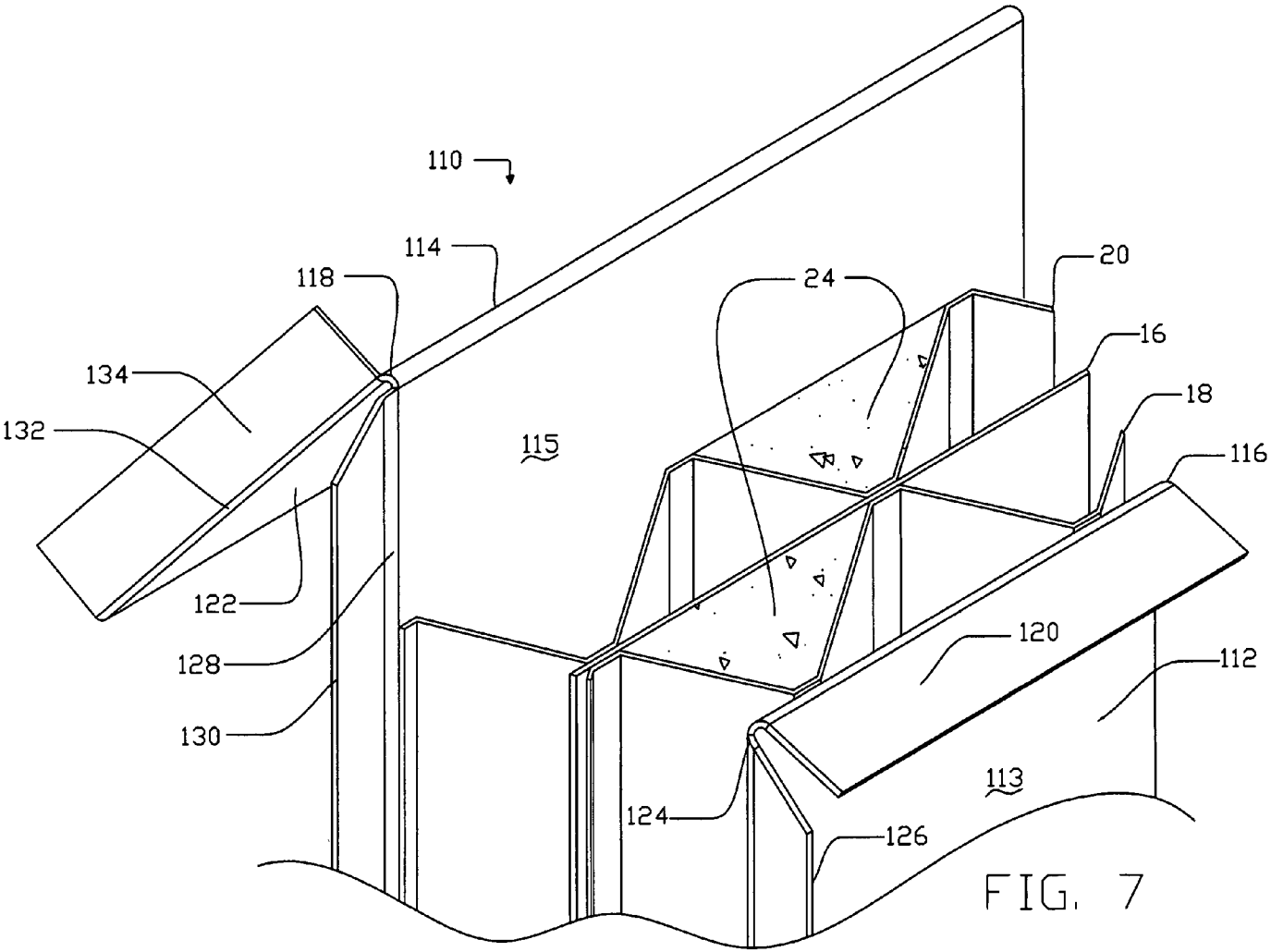
FIG. 7 is a perspective view of an another alternate embodiment of a ballistic construction panel, this embodiment is a wall panel and includes flexible flaps that extend from the outer and inner sheets.

Referring now to FIG. 7 another alternate embodiment of the invention is illustrated. Ballistic construction panel 110 is substantially the same as panel 10, however the inner sheet 112 and outer sheet 114 differ from sheets 12, 14.

Particularly, in this embodiment, the inner and outer sheets 112, 114 include additional flexible unconsolidated portions or flaps 116, 118 which extend beyond the rigid wall-like portion of the sheets. An attachment portion or section 120, 122 of additional rigid material extends from the respective flexible portions 116, 118. That is, sheet 112 includes a first rigid wall section 113 that is sized to substantially cover an abutting corrugated member 18, a flexible portion 116 which operates as a flap, and a second rigid attachment section 120. Similarly, sheet 114 includes a first rigid wall section 115 that is larger in both height and length than an abutting corrugated member 20, a flexible portion 118 which operates as a flap, and a second rigid attachment section 122. Each flap 116, 118 and its respective attachment section 120, 122 spans the entire length of the sheet 112, 114. The outer-most sheet 114 extends beyond the height of the rest of the panel 110 at least a distance equal to the overall thickness of the panel 110 (e.g., at least 8 in.). Flaps 116, 118 may only extend as far as necessary to allow the attachment sections 120, 122 to angle away from the first wall section 113, 115 (e.g., approximately equal to the thickness of the sheets 112, 114). In other embodiments, the flexible sections may extend much further from the sheet 112, 114 for a particular application. Attachment section 120 extends approximately six inches from its flexible portions, while attachment section 122 extends at least as far as the overall thickness of the panel 110 and is preferably within the range of 8 to 16 inches.

Figure 8:
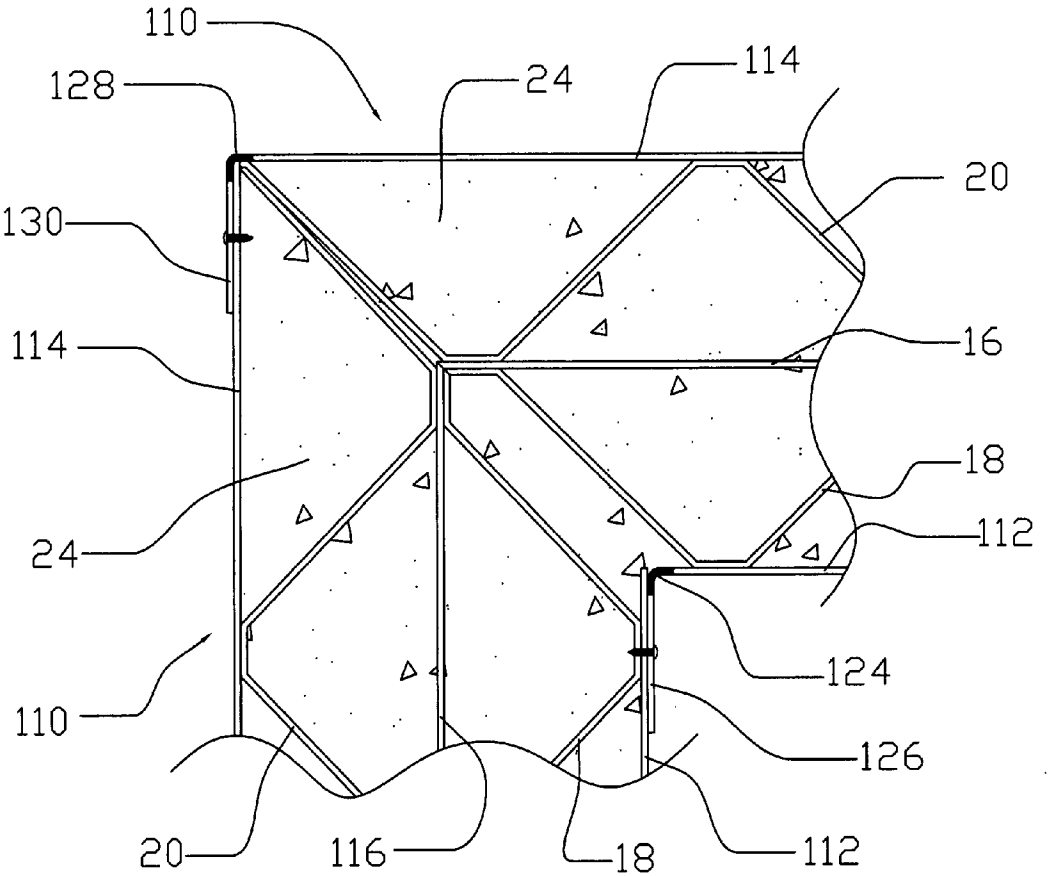
FIG. 8 is a partial top view illustrating how two ballistic construction wall panels shown in FIG. 6 are coupled together.

As shown in FIGS. 7 and 8, the outer-most and inner-most sheets 112, 114 may have flaps substantially the same as those described above, but disposed along the side edges of the sheets 112, 114. That is, inner sheet 112 may include a flexible portion 124 and an attachment portion 126, while outer sheet 114 may include a flexible portion 128 and an attachment portion 130. These flaps 124, 128 and attachment portions 126, 130 extend out from their respective sheets 112, 114 and allow rigid attachment portions 126, 130 to angle away from the planar rigid first wall sections 113, 115. Additionally, these portions 124-130 all are the same height as their respective wall section 113, 115. As best shown in FIG. 8, the outer sheet 114, middle sheet 16, and corrugated members 18, 20 extend beyond the wall section 113 of inner sheet 112 on both sides of the panel 110. Particularly, the outer sheet 114 extends the furthest and the remaining extended portions extend less and less. In this manner, the two side edges of the panel 110 are shaped at approximately 45 degree angles to allow an adjacent panel 110 to complete a 90 degree bend when they are abutted together. Flaps 124, 128 allow the attachment portions 126, 130 to abut the adjacent panel's outer and inner sheets to provide a location for the two panels to be coupled together.

Additionally, the embodiment shown in FIG. 7 also includes another flexible flap 132 that projects from the side edge of attachment portion 122. The flap 132 is coupled to another rigid attachment portion 134. As shown, flap 132 and portion 134 are located on the same side of panel 110 as flap 128 and attachment portion 130.

Figure 9:
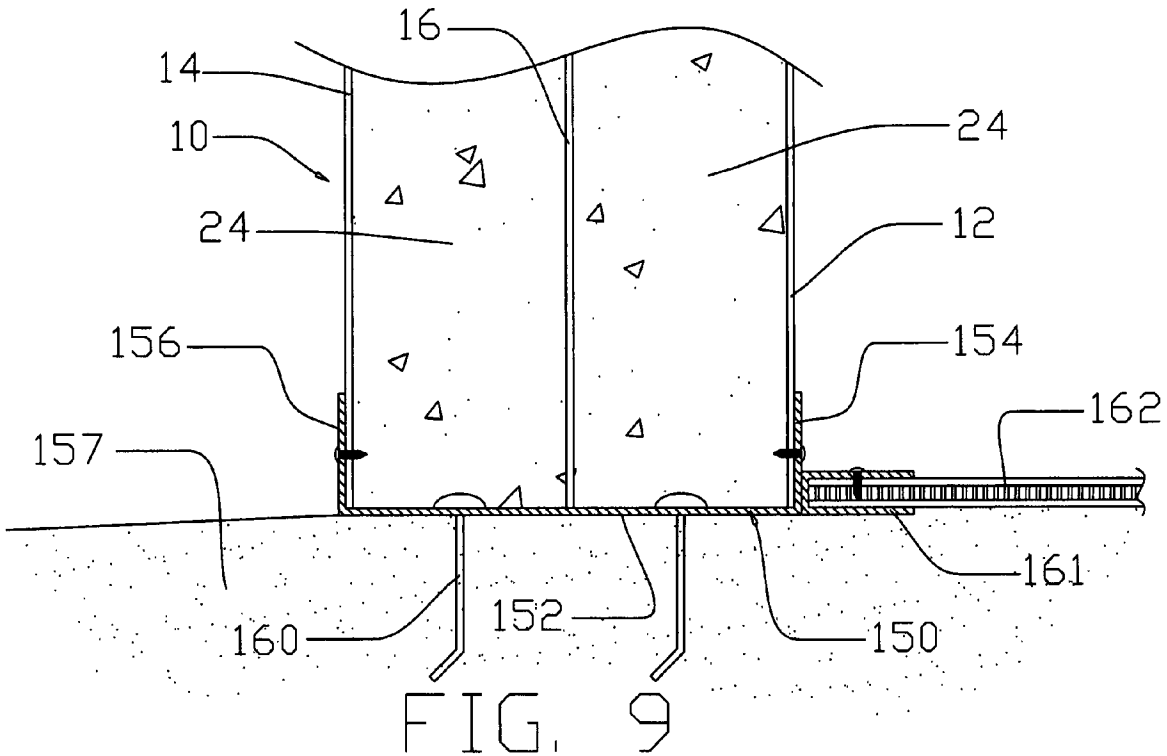
FIG. 9 is a sectional side view of a ballistic construction panel coupled to a ground-mounted sill member.
Figure 10:
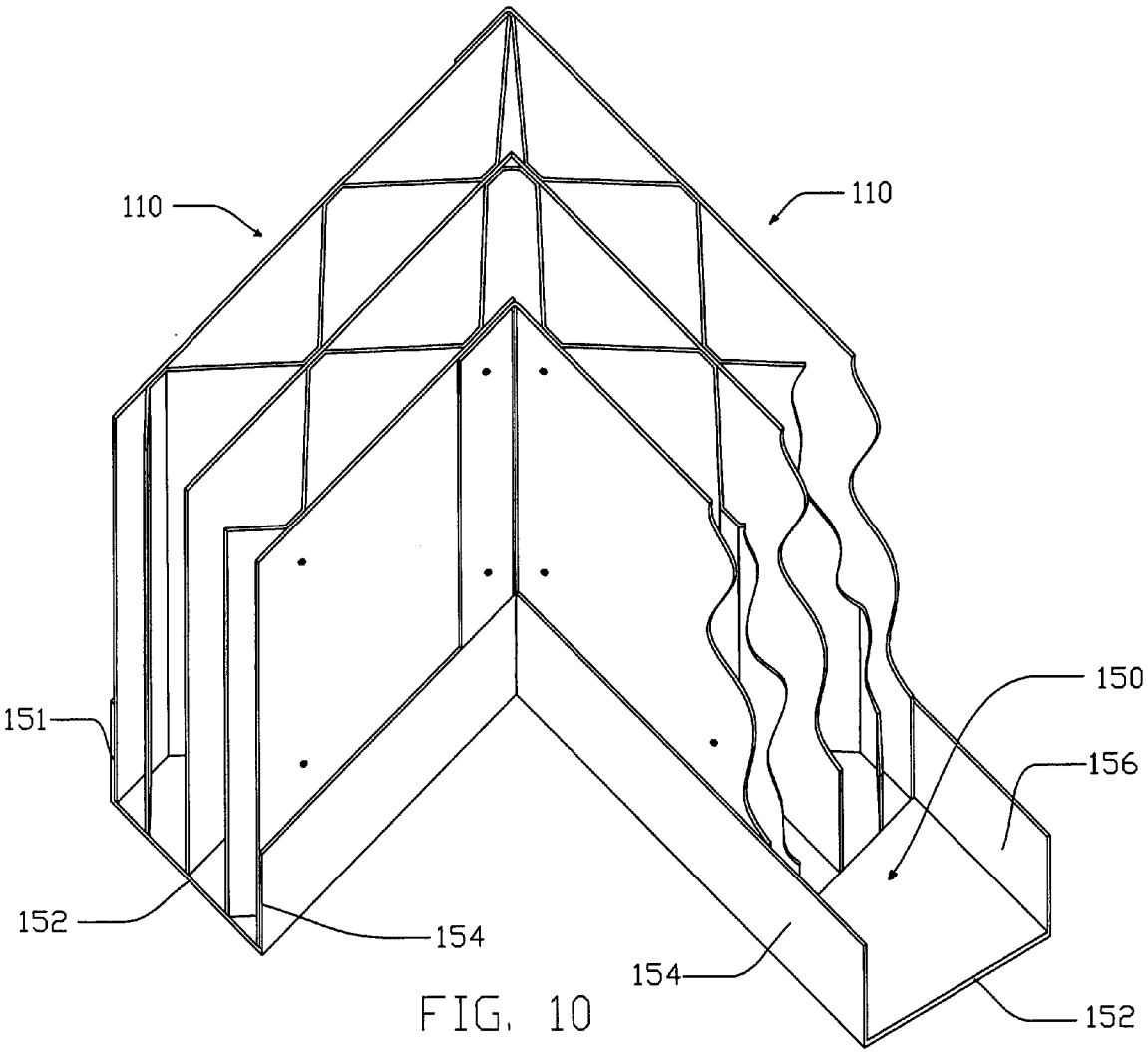
FIG. 10 is a partial cut-away perspective view of two ballistic construction wall panels disposed within a sill member.

Referring now to FIGS. 9 and 10, a sill 150 is shown in operational relationship with a construction panel 10, 110 being used as a wall panel. Sill member 150 has a generally channel-shaped cross-section having a web 152 and two upright flanges 154, 156. Sill 150 is preferably made from a metal or rigid plastic material, and is preferably a galvanized or non-corrosive metal. The flanges 154, 156 are parallel to each other and are spaced apart a distance which is equal to the overall thickness of the panel 10, 110. In the preferred embodiment, this distance is approximately eight inches. Each flange 154, 156 extends approximately four inches from the web 152.

Sill 150 is made up of elongated channels which, when interconnected, forms an endless annular channel that defines the perimeter of a temporary structure. Web 152 is placed onto the ground 157 with the two flanges 154, 156 projecting vertically. Anchoring hardware 160 may be used to hold the sill 150 down to the ground 157. Once a panel, such as panel 10, is disposed within the sill 150 the ballistic reinforcing filler material 24 may be poured into the panel 10 without the material 24 leaking out of the bottom. Sill 150, therefore acts as a cap or retaining member that cooperates with the inner and outer sheets 12, 14 to retain the material.

In other embodiments, sill 150 may be further employed to enclose or cap the sides and/or top of a panel 10 thereby creating a free-standing panel 10 which will not leak sand 24 after it has been filled.

Sill 150 may also include a floor containment channel 161 which is shaped as a second annular channel that projects orthogonally from the inner flange 154. This channel 161 provides a spot to anchor a flooring material 162 to the panels 10, 50, 60, 110 through the sill 150. The channel is sized to accept conventional boards or planks, such as two inch thick boards. In one non-limiting embodiment, the floor 162 is formed from a pair of sheets similar to sheets 12, 14 that cover a honeycomb configured grid. These sheets and grid may be formed from the same material as the sheets 12-16 and members 18, 20.

Figure 11:
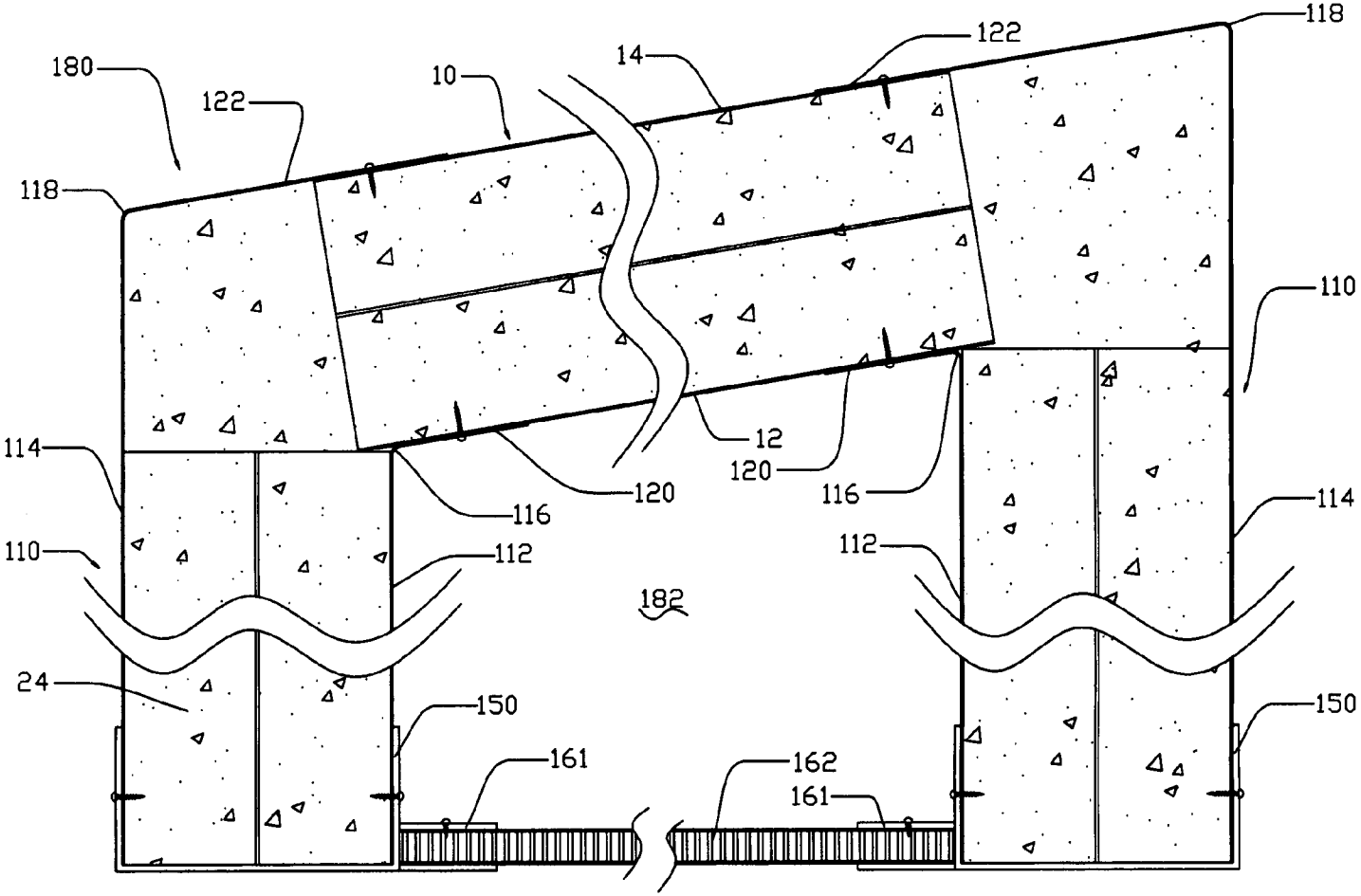
FIG. 11 is sectional side view of a structure constructed of ballistic construction wall panels.

A ballistic resistant temporary structure, such as the exemplary structure 180 shown in FIG. 11, may be constructed through the coupling of a plurality of ballistic construction panels 10, 110. Initially, the ground 157 is leveled and a sill 150 is anchored to the ground. The sill 150 defines the perimeter of structure 180. If desired, a sill having floor retaining channels 161 may be used and flooring 162 may be placed within the channels 161 which project inwardly from the inner flange 154.

Wall panels, such as panels 110 are oriented with their cells 21, 22 facing vertically and are placed within the sill 150 between the flanges 154, 156 with the horizontal flexible portions 116, 118 running along their top edges.

Where wall panels 110 intersect, they are coupled together as described above. After the walls 110 are coupled together, a roof panel, such as a panel 10, which is sized to span across opposing inner sheets 112 of the structure 180 is then placed on top of the walls 110. As shown in FIG. 11, two of the opposing walls 110 may be of different heights. This allows any water or rain to pour off of the roof panel. In addition to the rain removal benefit, the angled roof facilitates pouring of sand 24 into the empty cells 21, 22 of the roof panel.

Figure 12:
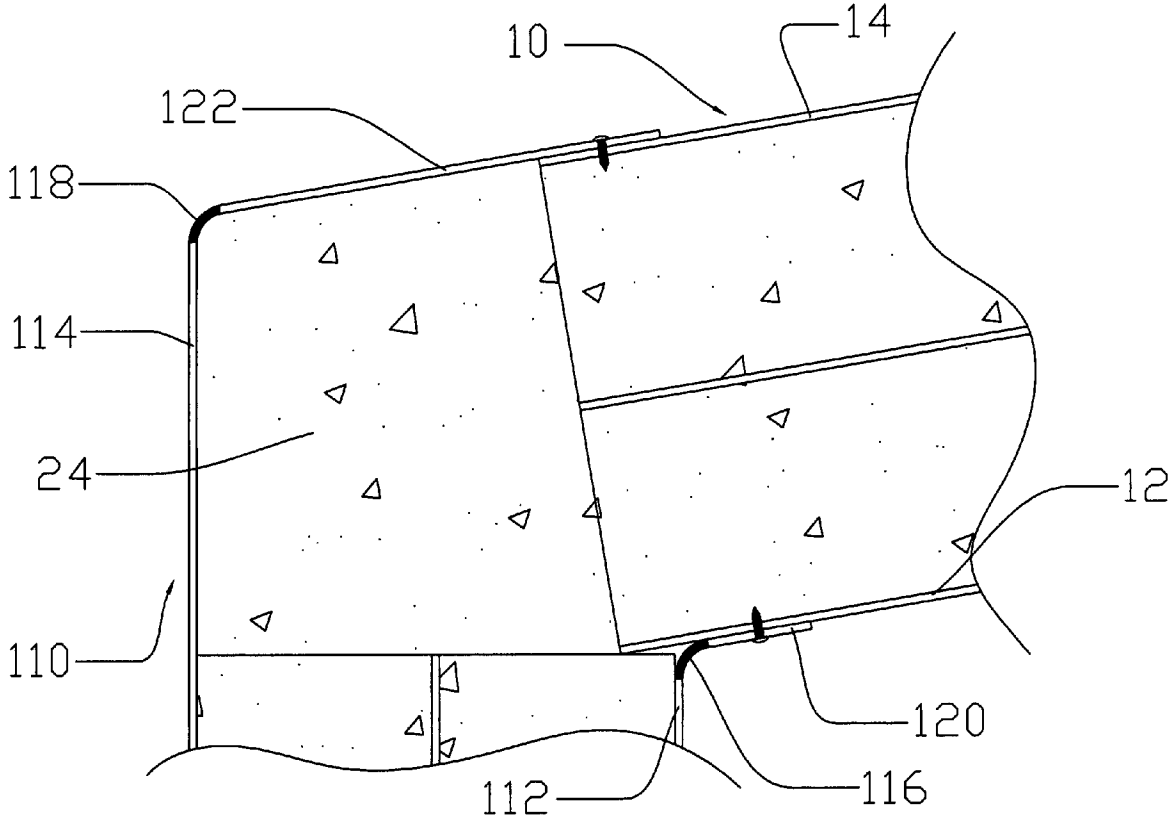
FIG. 12 is a partial sectional side view of a wall panel coupled to a roof panel.
Figure 13:
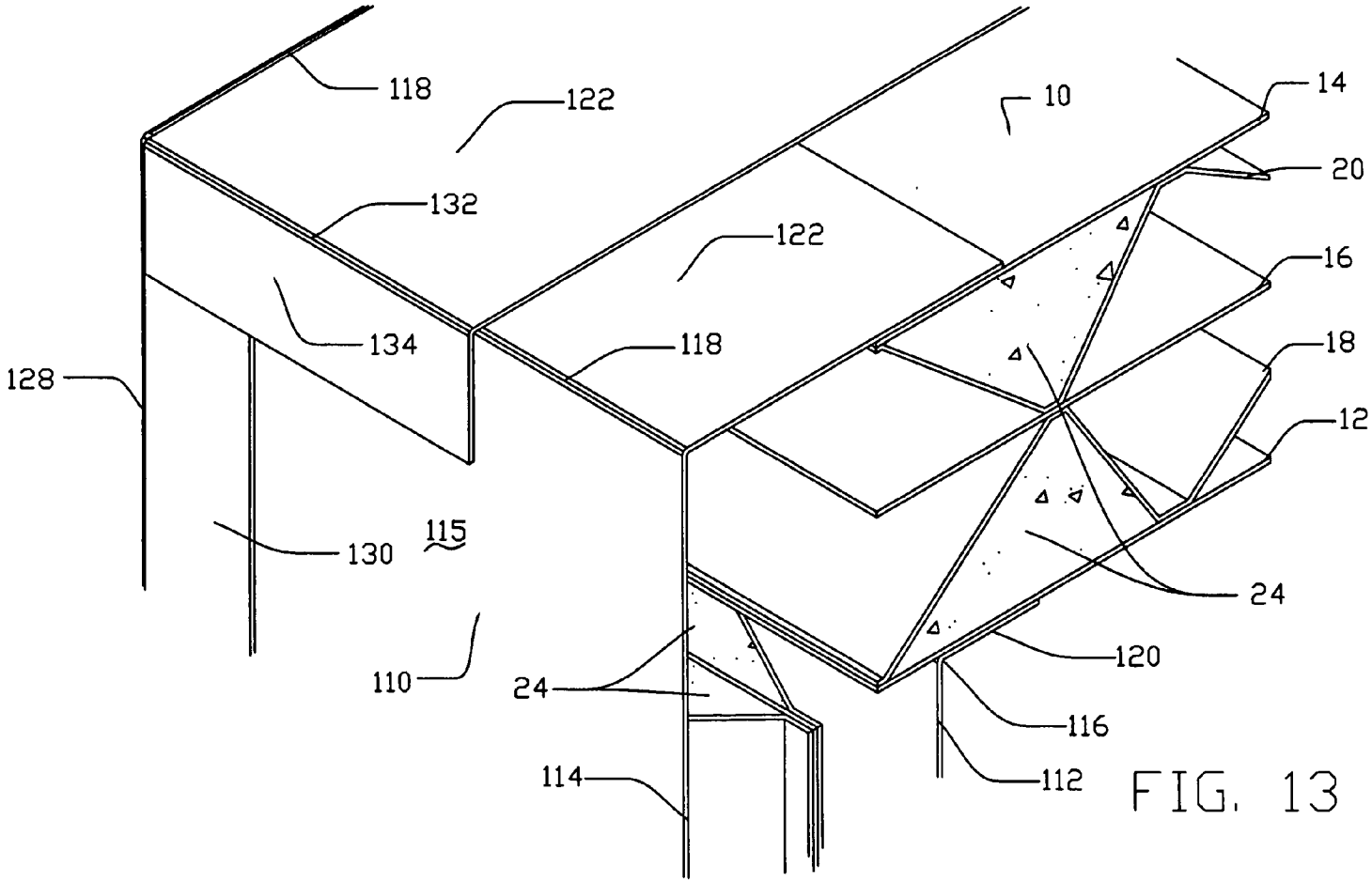
FIG. 13 is a partial perspective view of an alternate embodiment of a structure constructed of ballistic construction panels.

Referring now to FIGS. 11-13, the panel 10 that is used for the roof is coupled to the wall panels 110 by folding the flexible portions 116, 118 and coupling the horizontal attachment sections 120, 122 to the inner and outer sheets 12, 14 of the panel 10. As shown in FIG. 13, once attachment portion 122 is coupled to the roof panel 10 and is in a generally horizontal position, flap 132 is folded down along the outer surface of sheet 115 of the adjacent and perpendicular wall. Attachment portion 134 is then coupled to outer sheet 115. A portion of the attachment portion 134 covers the vertically disposed side attachment portion 130 that couples the two adjacent walls together.

It should be appreciated that the outer attachment section 122 of the taller wall panel (shown on the right side of FIG. 11) is left uncoupled to the roof to allow sand 24 to be poured down into the cells 21, 22 of the roof and into the void defined by the outer sheet 114, attachment section 122, and the top of the opposing shorter wall panel.

Once all of the wall panels 110 and roof panel are coupled together the cells 21, 22 of the panels 10, 110 can be filled with sand 24. In this regard, the horizontal flexible portions 118 and attachment sections 122 may be braced in a position to act as a funnel and direct the sand 24 being poured into the panels 110. To reduce the time needed to fill panels 10, 110, earth-moving equipment, such as front-end loaders, may be used to pour large amounts of sand 24 into the panel or panels. The fluid nature of dry sand will cause it to fill in and take the shape of the cells 21, 22.

Once the roof is filled with sand, the last attachment section 122 may be coupled to the roof panel. In this manner, the walls 110 and roof panel cooperate to define an enclosed living space 182 for the shelter 180.

In another embodiment, the walls 110 are filled with sand prior to placing the roof panel on top of the walls.

It should be appreciated that at least one of the wall panels 110 includes an entryway and possibly windows. To create such passages, portions of the wall merely need to be cut out from a wall panel. Caps, similar to sill 150, may be used to enclose the exposed inner areas of the wall panel 110 and thereby retain the sand within the wall.

Figure 14:
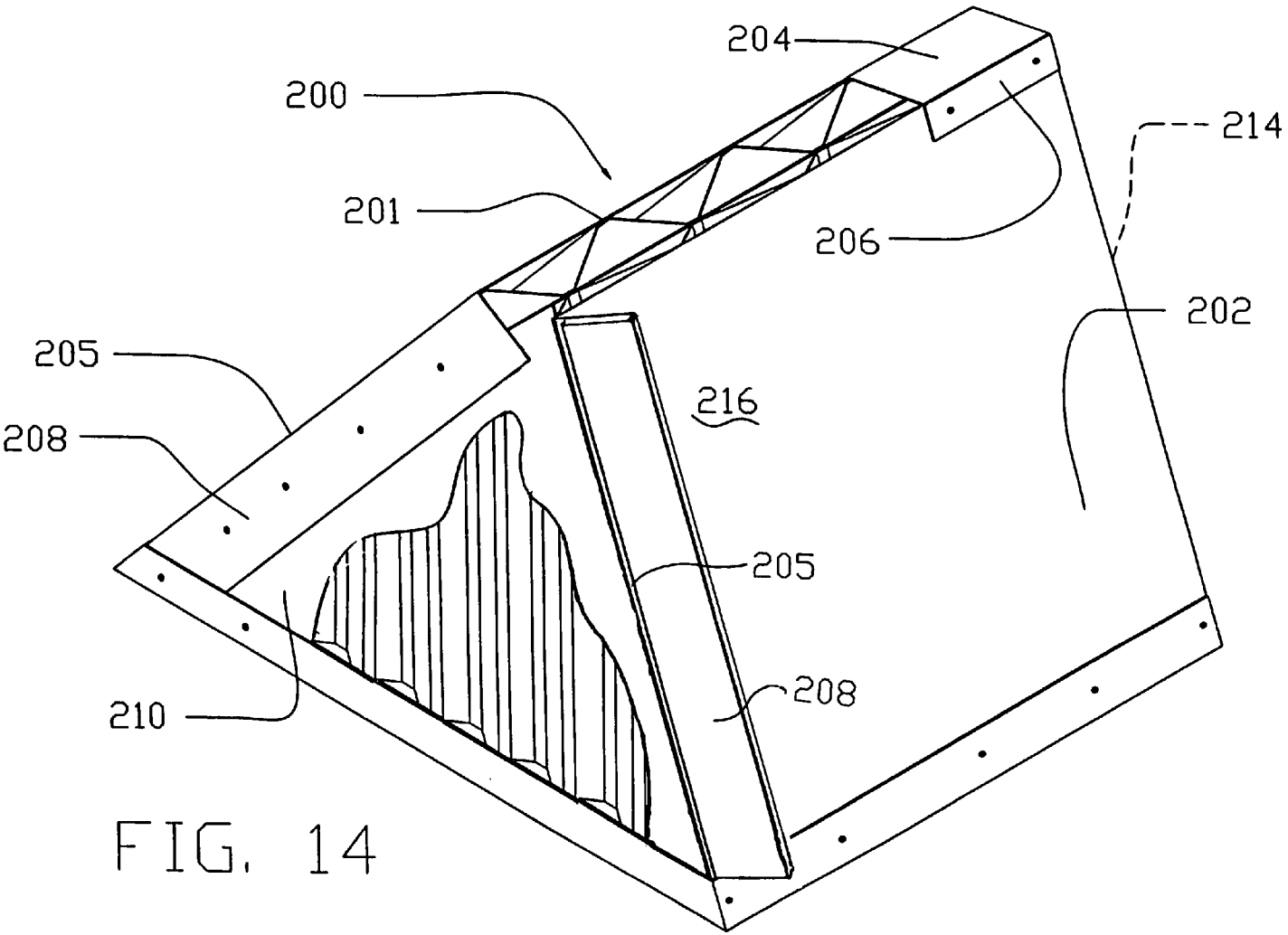
FIG. 14 is a partial perspective view of an alternate embodiment of a structure constructed of ballistic construction panels.

Referring now to FIG. 14, another exemplary structure 200 is shown. This structure 200 is simpler in design than structure 180 and is generally configured as a pup-tent. Structure 200 includes a pair of construction panels 201, 202 that are similar to panels 50 described above. Panel 201 include unconsolidated flaps 204 and 205. Flap 204 runs along the long side of panel 201, while flap 205 runs along a short side. Two rigid attachment portions 206, 208 project out of flexible flaps 204, 205.

Panels 201, 202 are angled toward each other and coupled together at attachment portion 206 to form an inverted "V" shape on the ground. A third triangular shaped panel 210 having a construction similar to panel 50 may be included and is sized to fit between the two coupled panels 201, 202 effective to close off one of the ends of structure 200. Attachment portions, such as portion 208 are coupled to this panel 210. Solid filler material 24 is placed within the cells of panels 201, 202, 210 in a manner similar to that described above.

The end 214 opposite to panel 210 is left open to allow access to the enclosed space 216. In this embodiment, structure 200 is sized to allow one or two adults to lay side by side within space 216.

Figure 15:
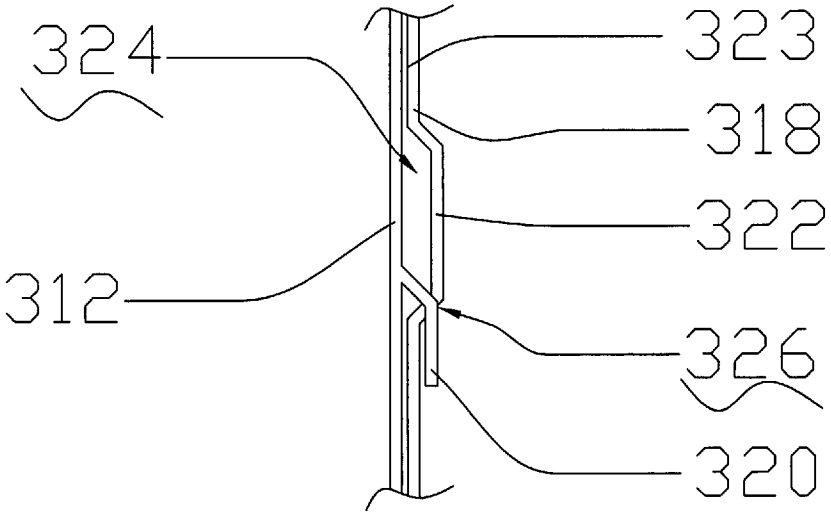
FIG. 15 is a partial side view of an alternate embodiment for coupling adjacent panels and corrugated members.

Referring now to FIG. 15, an alternate embodiment of the means for coupling adjacent panels and corrugated members is illustrated. A sheet 312 and a corrugated member 318 are provided. The sheet 312 and member 318 are identical in all respects except for those delineated below to the sheets and corrugated members described above (e.g., sheet 12 and corrugated member 18). Instead of coupling them together with conventional fasteners, however, sheet 312 includes a plurality of tabs 320 that first extends out from the sheet 312 and then turn parallel to the sheet 312. The corrugated member 318 includes an indented portion 322 on the face 323, which is analogous to face 28 of member 18. The tab 320 and indented portion 322 are integrally formed with their respective sheets 312 and corrugated members 318.

The indented portion 322 creates a space or gap 324 between the surface of portion 322 and the plane of face 323. The bottom of indented portion 322 includes an aperture 326 which is sized to receive the tab 320. Gap 324 is likewise sized to allow the entire tab 320 to fit within the gap 324. To couple the sheet 312 and corrugated member 318 together, tab 320 is first positioned within the gap 324 and then tab 320 is inserted through aperture 326, thereby interconnecting the sheet and corrugated member. It should be appreciated that a plurality of these connecting members 320, 322 are provided along the length and height of respective sheets and corrugated members to further increase the strength of the interconnection.

From the foregoing description, one skilled in the art will readily recognize that the present invention is directed to a ballistic object resistant construction panel, a structure utilizing such a construction panel, and methods for forming the same. While the present invention has been described with particular reference to various preferred embodiments, one skilled in the art will recognize from the foregoing discussion and accompanying drawing and claims that changes, modifications and variations can be made in the present invention without departing from the spirit and scope thereof as defined in the following claims.

What is claimed is:

1. A building structure having ballistic resistance, said building structure comprising:

a first ballistic wall panel and a second ballistic wall panel, each of said wall panels comprising:

a first corrugated wall member having vertically disposed channels; and at least two parallel spaced sheet members, said first corrugated wall member being sandwiched between the sheet members, said sheet members including a self-healing outermost sheet member and an innermost sheet member, each of said sheet members including a consolidated rigid wall section, an integral, unconsolidated flexible wall-mating edge and an integral, unconsolidated flexible roof-mating edge, said wall mating edge of said outermost sheet member of said first ballistic wall panel is coupled to said rigid section of said outermost sheet member of said second ballistic wall panel and said wall-mating edge of said innermost sheet member of said first ballistic wall panel is coupled to said rigid section of said innermost sheet member of said second ballistic wall panel;

a sill extending around said building structure to define a perimeter of said building structure, said first and second ballistic wall panels being disposed within said sill;

a ballistic roof panel, said roof panel comprising:

a roof panel corrugated member; and at least two parallel spaced rigid ballistic roof panel sheet members, said roof panel sheet members including a self-healing roof panel outermost sheet member and a roof panel innermost sheet member, said roof panel corrugated member being sandwiched between the ballistic roof panel sheet members, said ballistic roof panel being disposed spanning across opposing wall panels of said wall panels, said flexible roof-mating edge of said outermost sheet member being fastened to said roof panel outermost sheet member and said roof-mating edge of said innermost sheet member being fastened to said roof panel innermost sheet member; and a sand filler material disposed within and fills said first and second ballistic wall panels and said ballistic roof panel;

wherein the self-healing outermost sheet member and the self-healing roof panel outermost sheet member are configured to at least partially return to an original location after being penetrated by a projectile and to leave an opening smaller than the projectile.

2. The building structure of claim 1 wherein said sheet members and said corrugated members are formed from a fiber-reinforced plastic material.

3. The building structure of claim 1 wherein said roof-mating edges and said wall-mating edges include a first flexible portion and a second rigid fastening portion extending from said flexible portion.

4. The building structure of claim 1, further comprising a second corrugated wall member adjacent to the first corrugated wall member of the ballistic wall panel, the first and second corrugated wall members of the wall panel being connected by a fastener.

5. The building structure of claim 1, wherein the self-healing outermost sheet and the first corrugated wall member of the ballistic wall panel are connected with a fastener.

6. The building structure of claim 1, wherein each of the self-healing outermost sheet member and the self-healing roof panel outermost sheet member include fiberglass fibers commingled with polyolefin fibers.

7. The building structure of claim 1, wherein the self-healing outermost sheet member and the self-healing roof panel outermost sheet member, when in a punctured state, are configured to retain substantially all of the sand filler.

8. The building structure of claim 1, wherein the outermost sheet member further includes a rigid edge adjacent to the flexible wall-mating edge, the rigid edge forming an attachment section.

9. The building structure of claim 1, further comprising a thermally insulative material adjacent to the innermost sheet member.

10. The building structure of claim 1, wherein one of the opposing wall panels of said wall panels is taller than the other one of said opposing wall panels such that the roof panel is slanted and configured to facilitate pouring of the sand filler material into the roof panel.

11. A building structure having ballistic resistance, said building structure comprising:

a first ballistic wall panel and a second ballistic wall panel, each of said wall panels comprising:

a first corrugated wall member having vertically disposed channels; and at least two parallel spaced sheet members, said first corrugated wall member being disposed between the sheet members, said sheet members including a self-healing outermost sheet member and an innermost sheet member, each of said sheet members including a consolidated rigid wall section, an integral consolidated rigid wall edge, and an integral, unconsolidated flexible edge disposed therebetween, said first ballistic wall panel being coupled to said second ballistic wall panel by said rigid edge of said outermost sheet member of said first ballistic wall panel connected to the second ballistic wall panel;

a sill, wherein said first and second ballistic wall panels are disposed within said sill;

a ballistic roof panel connected to the first and second ballistic wall panels; and a granular filler material disposed within said first and second ballistic wall panels;

wherein the self-healing outermost sheet member is configured to at least partially return to an original location after being penetrated by a projectile and to leave an opening smaller than the projectile.

12. The building structure of claim 11, further comprising a second corrugated wall member disposed adjacent to the first corrugated wall member in a repeating wave form wherein the wave form includes first corrugated wall member being oppositely facing relative to the second corrugated wall member.

13. The building structure of claim 11, wherein the corrugated wall member has a uniform cross-section.

14. The building structure of claim 11, wherein the outermost sheet member includes a fiber-reinforced thermosetting composite composition.

15. A building structure having ballistic resistance, said building structure comprising:

a first ballistic wall panel and a second ballistic wall panel, each of said wall panels comprising:

a first corrugated wall member having vertically disposed channels; and a first sheet member and a second sheet member, said first corrugated wall member being disposed between the sheet members, said sheet members including a self-healing outermost sheet member and an innermost sheet member, each of said sheet members including a consolidated rigid wall section, an integral consolidated rigid wall edge, and an integral, unconsolidated flexible edge disposed therebetween, said first ballistic wall panel being coupled to said second ballistic wall panel by said rigid edge of said outermost sheet member of said first ballistic wall panel connected to the second ballistic wall panel; and a sill, said first and second ballistic wall panels being disposed within said sill, wherein the first ballistic wall panel and the second ballistic wall panel meet at a first end of each of said panels and are separated at a second end of each of said panels disposed within the sill to form an inverted V shape with the first ends of each of said panels forming an apex of the inverted V shape;

wherein the self-healing outermost sheet member is configured to at least partially return to an original location after being penetrated by a projectile and to leave an opening smaller than the projectile.

16. The building structure of claim 15, wherein the outermost sheet member further includes a rigid edge adjacent to the flexible wall-mating edge, the rigid edge forming an attachment section.

17. The building structure of claim 15, wherein the integral consolidated rigid edge of the first ballistic panel includes a tab and the second ballistic wall panels include a slot adapted to cooperate with the tab at the end where the first and second ballistic panels meet.

18. The building structure of claim 15, further comprising a sand filler disposed within the vertically disposed channels.

19. The building structure of claim 15, further comprising a layer of polyurethane foam disposed on at least one of said innermost sheet members.

* * * * *